US010954619B2

(12) United States Patent
De Pellegrin

(10) Patent No.: US 10,954,619 B2
(45) Date of Patent: Mar. 23, 2021

(54) HOUSEHOLD APPLIANCE WITH AN ELECTRONIC BOARD AND METHOD FOR MANUFACTURING A HOUSEHOLD APPLIANCE

(71) Applicant: Electrolux Appliances Aktiebolag, Stockholm (SE)

(72) Inventor: Andrea De Pellegrin, San Foca di San Quirino (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 139 days.

(21) Appl. No.: 16/064,080

(22) PCT Filed: Dec. 7, 2016

(86) PCT No.: PCT/EP2016/079977

§ 371 (c)(1),
(2) Date: Jun. 20, 2018

(87) PCT Pub. No.: WO2017/114642

PCT Pub. Date: Jul. 6, 2017

(65) Prior Publication Data

US 2019/0003103 A1 Jan. 3, 2019

(30) Foreign Application Priority Data

Dec. 29, 2015 (EP) ..... 15202987

(51) Int. Cl.

| | |
|---|---|
| ***D06F 34/28*** | (2020.01) |
| ***D06F 34/08*** | (2020.01) |
| ***D06F 39/12*** | (2006.01) |

(52) U.S. Cl.
CPC ..... *D06F 34/28* (2020.02); *D06F 34/08* (2020.02); *D06F 39/12* (2013.01); *D06F 2212/02* (2013.01)

(58) Field of Classification Search
CPC ..... D06F 34/28; D06F 39/12; D06F 2212/02; D06F 2216/00; D06F 34/08
See application file for complete search history.

(56) References Cited

U.S. PATENT DOCUMENTS 5,243,453 A * 9/1993 Kawaguchi ..... D06F 34/28 349/60
5,748,270 A * 5/1998 Smith ..... G02F 1/13452 349/149

(Continued)

FOREIGN PATENT DOCUMENTS

DE 19651821 A1 6/1998
DE 20210707 U1 11/2003

(Continued)

OTHER PUBLICATIONS

International Search Report and Written Opinion for International Application No. PCT/EP2016/079977, dated Feb. 17, 2017, 10 pages.

*Primary Examiner* — Joseph L. Perrin
(74) *Attorney, Agent, or Firm* — RatnerPrestia

(57) ABSTRACT

Household appliance including an electronic board, and a receptacle which receives the electronic board and a cover for closing the receptacle. In an assembled state, the cover is connected to said the receptacle and a screw provides connection between the receptacle and the cover. A sealing element is also provided for providing a sealed connection between the receptacle and the cover in the assembled state.

14 Claims, 9 Drawing Sheets

(56) References Cited

U.S. PATENT DOCUMENTS

| | | | | |
|---|---|---|---|---|
| 7,215,390 | B2 | 5/2007 | Mörsch | |
| 7,700,900 | B2 * | 4/2010 | Geiger | D06F 34/28 219/506 |
| 7,826,002 | B2 * | 11/2010 | Lee | G02B 6/0065 349/149 |
| 7,834,950 | B2 * | 11/2010 | Morishita | G02F 1/133308 349/58 |
| 8,763,432 | B2 * | 7/2014 | Yoon | A47L 15/4274 68/12.27 |
| 2004/0172986 | A1 * | 9/2004 | Heo | D06F 37/42 68/19 |
| 2005/0073628 | A1 * | 4/2005 | Morsch | G02F 1/133308 349/67 |
| 2014/0049926 | A1 * | 2/2014 | Bas | D06F 34/28 361/759 |
| 2015/0341072 | A1 * | 11/2015 | Lai | H04M 1/026 455/575.8 |
| 2017/0121889 | A1 * | 5/2017 | Kwon | D06F 37/266 |
| 2018/0038040 | A1 * | 2/2018 | Kim | D06F 37/22 |
| 2018/0081408 | A1 * | 3/2018 | Lilje | H01R 13/52 |

FOREIGN PATENT DOCUMENTS

| | | | | |
|---|---|---|---|---|
| EP | 1176619 | A2 | 1/2002 | |
| EP | 1645679 | A2 | 4/2006 | |
| EP | 2380479 | A1 | 10/2011 | |
| EP | 2458060 | A1 | 5/2012 | |
| EP | 2876196 | A1 | 5/2015 | |
| WO | WO-2015022182 | A1 * | 2/2015 | D06F 39/12 |

* cited by examiner

HOUSEHOLD APPLIANCE WITH AN ELECTRONIC BOARD AND METHOD FOR MANUFACTURING A HOUSEHOLD APPLIANCE

This application is a U.S. National Phase application of PCT International Application No. PCT/EP2016/079977, filed Dec. 7, 2016, which claims the benefit of European Application No. 15202987.2, filed Dec. 29, 2015, both of which are incorporated by reference herein.

FIELD OF THE INVENTION

The invention generally relates to a household appliance. The invention more particularly relates to household appliance comprising an electronic board. The invention furthermore relates to a method for manufacturing a household appliance.

BACKGROUND OF THE INVENTION

Known household appliances such as laundry machines, i.e. washing machines, driers, and combined washer/driers, are usually provided with a user interface comprising a dashboard or control panel with input devices, knobs, buttons, etc., allowing the user to select or set washing and/or drying programs. The dashboards are typically provided also with output devices such as displays, LEDs, etc. for giving a feedback to the user related to the settings/status of the machine.

Some of these dashboards are provided with capacitive touch sensitive input devices that detect the contact of the user by means of capacitive change. An electronic board, which can comprise controls to be operated on the user interface, is provided for, as way of example, receiving the user input, sending signals to a display to show information to the user on the current running or selected program and/or parameters thereof, and to operate valves for water supply or drain, to operate a motor for rotating a drum etc.

In order to ensure proper operation of the electronic board and to arrange it close to the user interface, it can be arranged in a receptacle which is then closed by a cover.

Disadvantageous of such a solution is the difficult replacement of the electronic board.

The EP 2 876 196 A1 discloses a household appliance with a front panel, whereby on the rear side of the front panel a receptacle is arranged which receives an electronic board. A cover for closing the receptacle is not provided thus the electronic board can be subject to moist, steam, water or particles which can lead to malfunctioning of the electronic board.

The aim of the invention is to provide a household appliance with at least one control circuit board comprising peripheral contacts that is easy to replace and reliably protected against moist and dirt.

Another aim of the invention is to provide a household appliance which is easy to assemble and has an optimized reduced number of components.

Another aim of the invention is to provide a method for assembling a household appliance.

DESCRIPTION OF THE INVENTION

In a first aspect, the invention relates to a household appliance, comprising an electronic board and a receptacle which receives the electronic board, further comprising a cover for closing the receptacle, whereby the cover in an assembled state is connected to the receptacle, whereby fixing means are provided for a connection between the receptacle and the cover, and whereby a sealing element is provided for providing a sealed connection between said receptacle and said cover in an assembled state.

Preferred embodiments of the invention are described in relation to the dependent claims and the description of the enclosed drawings.

The invention is based on the consideration that an electronic board, which is an essential component of the appliance, should be protected against moisture, steam, water and particles which could lead to a reduced functionality, malfunction or defect of the board. Such a protection can be achieved in a natural way by placing the electronic board in a box and by closing the box by a cover.

This configuration, however, is disadvantageous since moisture and steam and contaminating particles can possibly enter the box between cover and lead to malfunctions or defects of the board.

Applicant has found that a reliable protection of the electronic board can be achieved by providing fixing means for connecting receptacle and cover and by providing a sealing element which seals the connection between receptacle and cover.

Preferably, the fixing means provide a removable connection between the receptacle and the cover. This allows an easy replacement of the electronic board in a convenient and a non-destructive way. In this way, malfunctions of the board due to humidity or contaminating are prevented in the first place. If, however, the board needs to be replaced, this can be performed in a convenient and non-destructive way.

A sealed connection denotes especially a connection which seals against water/steam/humidity/contaminating particles as they occur within or in the periphery of a household appliance during operation.

The receptacle is preferably built as a box and/or has essentially a box-like shape, especially at least one face wall and for orthogonal side walls.

In a first preferred embodiment, the sealing element is arranged on the receptacle.

In a second preferred embodiment, the sealing element is arranged on the cover. This configuration has advantages over the previous one during manufacturing, since the cover typically is a smaller component than the receptacle, the corresponding machine/mold for providing the sealing element on the cover can be dimensioned smaller.

The sealing element preferably is a gasket which is co-molded to the cover. In this way, a robust and tight connection between gasket and cover can be achieved, yielding good sealing properties. The gasket is preferably made of rubber.

The cover at its periphery advantageously comprises a groove, whereby the gasket is positioned at least partially inside the groove. In this way, a force fit and/or form-locking connection between gasket and cover is established. Additionally, the gasket is partly located inside the cover, allowing a compact design of the cover.

Preferably, the cover at its periphery comprises a frame from which two parallel shoulders protrude which form this groove between them, whereby the gasket is positioned at least partially inside the groove and covers at least one of these shoulders, whereby in the assembled state the gasket is arranged between at least one shoulder and a side surface of the receptacle, thereby sealing the connection between the receptacle and the cover.

The cover preferably comprises a frontal side which in an assembled state faces the electronic board, and a back side opposed to said frontal side, and wherein on the cover on the frontal side gasket tracks are provided which in an assembled state face the electronic board. These tracks are preferably built as grooves or channels which during a molding process allow the liquid material to flow into regions where the gasket should be co-molded to the cover and possibly other parts of the cover where the material is needed.

The cover preferably comprises a frontal side which in an assembled state faces the electronic board and a back side, wherein the cover on said frontal side comprises least one at least partially circumferential groove and an injection point for the molding material which is connected to at least one track through which material when injected in a liquid state in said injection point is allowed to flow.

At least one connecting groove is advantageously provided from the injection point to the at least one at least partially circumferential groove, and whereby material when injected in a liquid state in the injection point is allowed to flow into the at least one at least partially circumferential groove.

Advantageously, the cover comprises at least one hole for insertion of fixing means. These fixing means are advantageously screws.

The receptacle comprises at least one dome/protrusion for insertion of a screw, whereby the electronic board comprises at least one hole, and whereby the cover comprises at least one opening, whereby the dome, the hole and the opening are axially aligned in an assembled state so that a fixing element is lead through the opening, the hole and through the dome. The fixing element is preferably a screw. Alternatively, it can be a pin or snap means.

The opening is preferably surrounded by a dome. In other words, a dome is provided on the cover with the opening inside.

Advantageously holes are provided on said cover in the domes. These holes preferably respectively comprise an inner thread which fits with a respective outer thread of the corresponding screw.

Preferably, the household appliance comprises a frontal plate or face plate, whereby a removable connection between the receptacle and the faceplate is provided. This connection is preferably achieved by a snap connection, whereby snap elements, especially snap teeth, are provided on receptacle and/or faceplate which engage with corresponding receiving elements on the other part.

The frontal plate preferably comprises a front side and a rear side facing the interior of said household appliance and which in an assembled state faces the receptacle, whereby on the rear side at least one fixing means, especially for insertion of a screw, is provided.

The face plate advantageously comprises a user interface. The user interface preferably comprises at least one user interface element with which the user can operate with the machine and preferably a least one display element and/or light element for indicating status information on the current status of the appliance.

The electronic board preferably comprises a connector cage encompassing at feast one contact, and whereby a connector sealing element is provided on the cover which at least partially in a sealing manner encompasses the connector cage.

The connector sealing element is preferably a gasket which is co-molded to the cover.

The connector sealing element advantageously comprises a frontal lip and a rear lip and two side lips, whereby the frontal and rear lips, respectively, have the length of corresponding sides of the connector cage.

The length of the respective side lip thereby preferably equals to the length of the adjacent side of the connector cage. In this way, a sealed connection at the connector cage is provided, preventing steam or water or particles to reach the inside of the receptacle and to reach the side of the electronic board which faces the frontal plate of the appliance. In this way damage of the electronic board can be prevented.

In an alternate embodiment, the length of the respective side lip exceeds the length of the adjacent side of the connector cage. This design allows using the same cover for electronic boards with different lengths of the connector cage.

Preferably a removable connection is provided between the electronic board and the cover.

In a second aspect, the present invention relates to a method for manufacturing a household appliance, whereby the appliance comprises an electronic board, a receptacle, preferably a box, for receiving the electronic board and a cover for closing the receptacle, whereby the electronic board is placed inside the receptacle and the receptacle is closed by the cover, whereby before closing the receptacle by the cover, the cover is placed in a mold, and a gasket is co-molded on the cover in such a way that it provides a sealing connection between the receptacle and the cover in their assembled state.

In a preferred embodiment, the cover comprises at least one at least partially circumferential groove and an injection point for the molding material, whereby at least one connecting track, especially a groove, is provided from the injection point to the at least one at least partially circumferential groove, and whereby material in a liquid state is injected in the injection point and allowed to flow into the at least one at least partially circumferential groove.

This design of the cover allows the liquid material to flow from the injection point through the tracks and to reach all regions in which the gasket is to be formed. The gasket by this method is therefore actively formed.

The cover preferably comprises at least one through-point, and whereby during molding, gasket material is allowed to flow into the through-point. The through-point is preferably a channel or opening in the cover.

The invention relates also to a household appliance, comprising an electronic board and a receptacle which receives said electronic board, further comprising a cover for closing said receptacle, whereby said cover in an assembled state is connected to said receptacle, whereby fixing means are provided for a, especially removable, connection between the receptacle and the cover, whereby the electronic board comprises a connector cage encompassing at least one contact, and whereby a connector sealing element is provided on the cover which at least partially in a sealing manner encompasses the connector cage.

The task solved by this appliance is to protect the electronic board with a connector cage from moist or dirt which could enter between cover and connector cage.

The connector sealing element is preferably a gasket co-molded to the cover.

Advantageously, the connector sealing element comprises a frontal lip and a rear lip and two side lips, whereby the frontal and rear lips have the length of corresponding sides of the connector cage. This configuration provides a tight sealing connection between the cover and the connector cage. While the contacts inside the connector cage remains accessible and can be connected by a connector and at the same time the space between electronic board and the receptacle opposite to the cover is at least partially sealed against steam or water or particles inside the appliance.

The length of the respective side lip advantageously is equal to the length of the adjacent side of the connector cage. In this way, a sealed connection along the whole periphery of the connector cage is provided In an alternative embodiment, the length of said respective side lip exceeds the length of the adjacent side of said connector cage.

The advantages of the invention are especially as follows. The sealing element simultaneously seals all important parts between the cover and the electronic board and thereby provides a reliable protection of the electronic board from steam, water or contaminating particles. In this way, the proper functioning of the appliance is enabled and the lifetimes of these electronic components and also of the whole appliance are prolonged.

The combination of the electronic board, the box, the faceplate and the cover offers a great simplicity of the assembly. Only a few pieces are needed, and only few connection means are needed to firmly and securely connect these components.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

Same parts are labelled by identical reference numerals.

DESCRIPTION OF THE INVENTION

Figure 1:
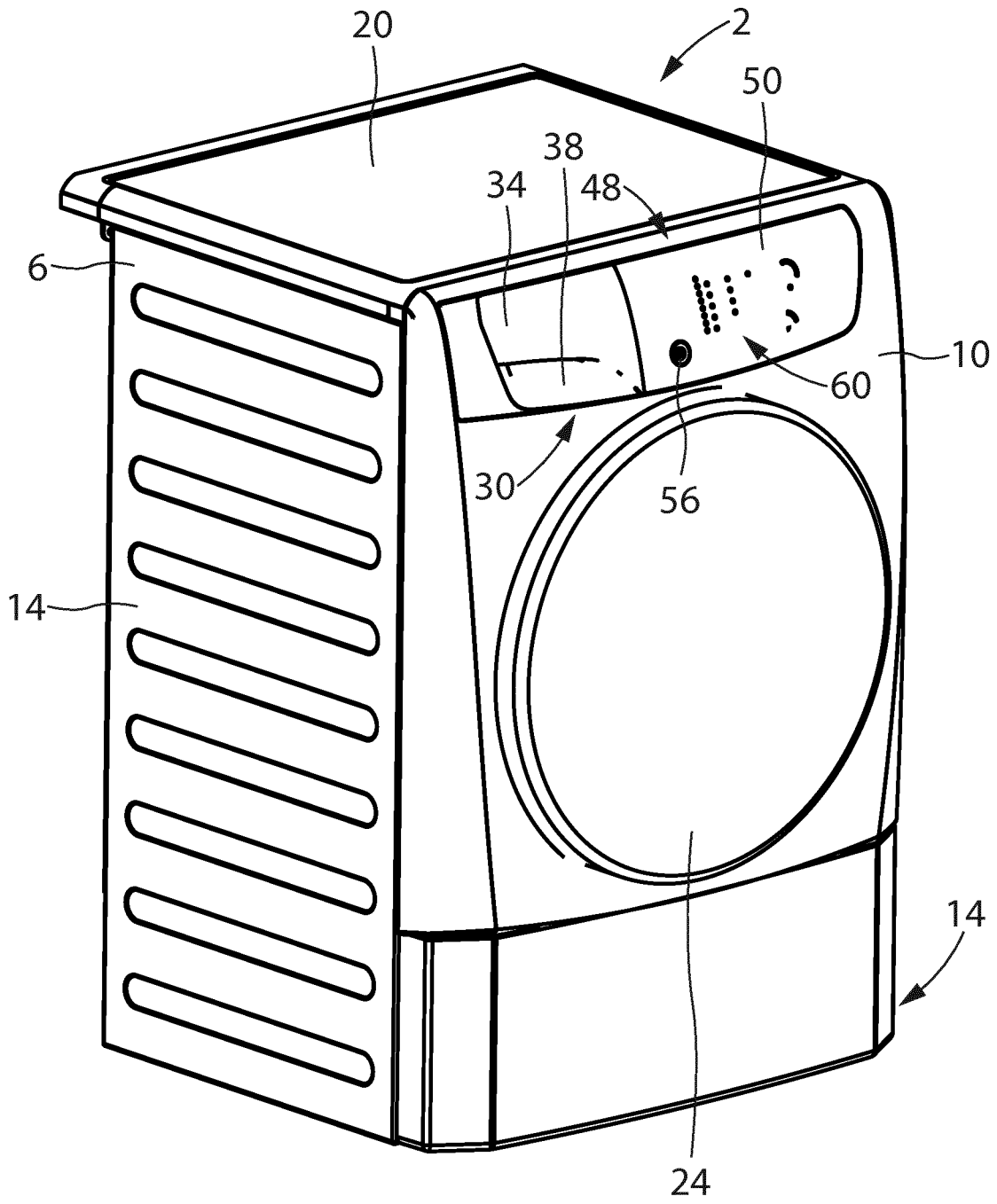
FIG. 1 shows a laundry treatment appliance with a front panel in a preferred embodiment.

In FIG. 1, a laundry treatment appliance 2 is shown which is built as a front-loading washing machine and comprises a housing or casing 6 with a preferable parallelepiped shape, the casing 6 comprising a front wall 10, two side walls 14, a cover plate 20 and a rear wall (not shown). Front wall 10 and side walls 14 are preferably part of a cabinet. A front door 24 is provided which can be opened for loading or unloading laundry through an opening into a washing drum.

Advantageously a washing tub is contained within casing 6, whereby a rotatable and perforated drum is contained by said washing tub. Both washing tub and drum have a substantially cylindrical shape. Advantageously the tub is suspended in a floating manner inside casing 6 by means of a number of coil springs and shock absorbers. The drum is rotated by an electric motor (not shown), which transmits the rotating motion of a motor shaft to the drum by a belt/pulley system. In a different embodiment of the invention, the motor can be directly associated with the shaft of the drum. The tub is preferable connected to casing 6 by means of an elastic bellows or gasket. Alternatively, the laundry appliance can be a dryer (in which case the tub is not provided) or a combined washer and dryer.

The preferred washing machine shown in FIG. 1 on a front panel 48 comprises a drawer 30 with a front plate 34 and a handle 38 for pulling out and pushing back in drawer 30. Drawer 30 comprises at least one compartment for detergent or washing additives. Adjacent to drawer 30, a user interface 50 is provided. On user interface 50, preferably a switch 56 is provided for switching on/off appliance 2. Preferably, user interface elements 60 such as, for example, touch buttons, light elements, display elements, are provided.

Figure 2:
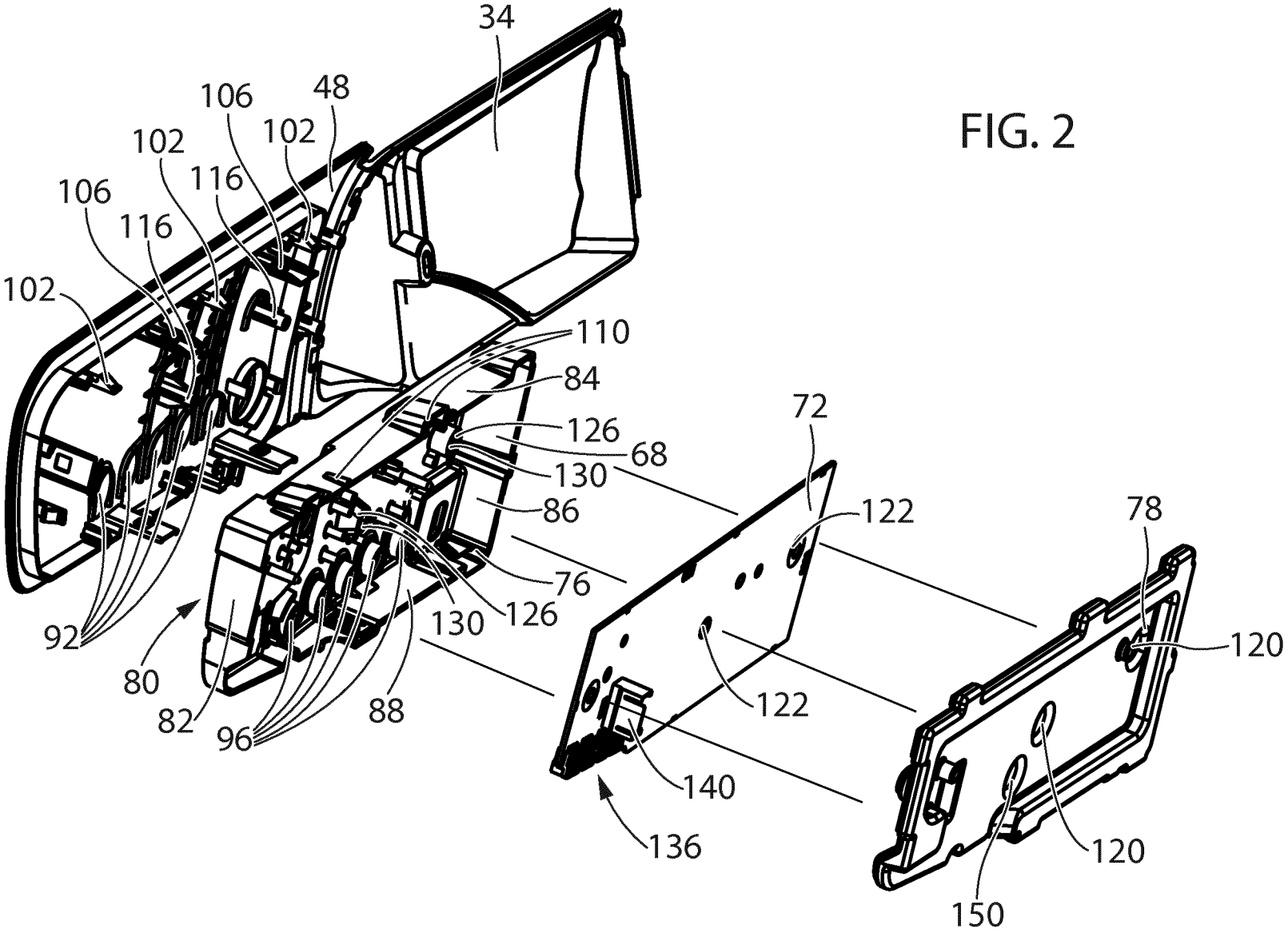
FIG. 2 shows an explosive view of the front panel of according to FIG. 1, a box, an electronic board and a box cover.

In FIG. 2, front panel 48, a box/receptacle 68, an electronic board 72 and a cover 78 are shown in an explosive view. Box 68 is a receptacle which in an assembled state receives electronic board 72. In the assembled state, cover 78 is closing box 68. Box 68 comprises a front wall 80 which in the assembled state faces front panel 48 and four adjacent side walls 82, 84, 86, 88.

Front panel 48 preferably comprises openings or holes or depressions 92 which in the assembled state receive protrusions 96 of box 68 which house touch contacts of touch sensors of touch switches which are arranged on board 72.

Front panel 48 preferably comprises snap means 102 for attaching front panel 48 to the casing 6 of laundry treatment appliance 2. Snap means 106 are preferably provided on front panel 48 which engage with corresponding snap means 110 on box 68.

For the connection of front panel 48, box 68 and cover 78 in the assembled state, on front panel 48 two domes 116 for insertion of fixing means, which in the present preferred embodiment are screws, are preferably provided. For the assembly of frontal panel 48, box 68, board 72 and cover 78, these screws are preferably guided first through openings 120 in cover 78 and subsequently through openings 122 in board 72, which are built as domes with holes, and openings 130 of domes 126 on box 68. The screws then reach into domes 116 of front panel 48 which, respectively, comprise an inner thread into which the respective screw with an outer thread is screwed.

The box 68 is preferably attached to front panel 48 by engaging of snap means 106 on front panel 48 with snap means 110 on box 68. The electronic board 72 is preferably attached to box 68 by snap means 76. Then the box 68 is closed by cover 78, thereby closing the internal space of box 68 in which electronic board 72 is arranged. Then, as the last assembly step, the same screws are then passed through these four components. Therefore, the same fixing means or connection means are used to for front panel 48, box 68, board 72 and cover 78, which yields an especially convenient and simple way to attach these components in a removable way.

By the described connection between front panel 48, box 68 and cover 78, a connection is provided which only requires few and simple connection means and is removable. The electronic board 72 is housed in box 68 which is closed by cover 78. Since this connection is removable, the cover 78 is detachable from box 68 by loosening the above described screws; the electronic board 72 can easily be removed and repaired or replaced. Snap means 76 are preferably provided at the internal periphery of box 68 for engagement of box 68 with electronic board 72, thereby spatially fixing the electronic board 72 with respect to box 68.

Board 72 preferably comprises a first group of contacts 136 which are located at the periphery of board 72. Board 72 preferably further comprises a connector cage 140 in which a second group of contacts is provided.

Figure 3:
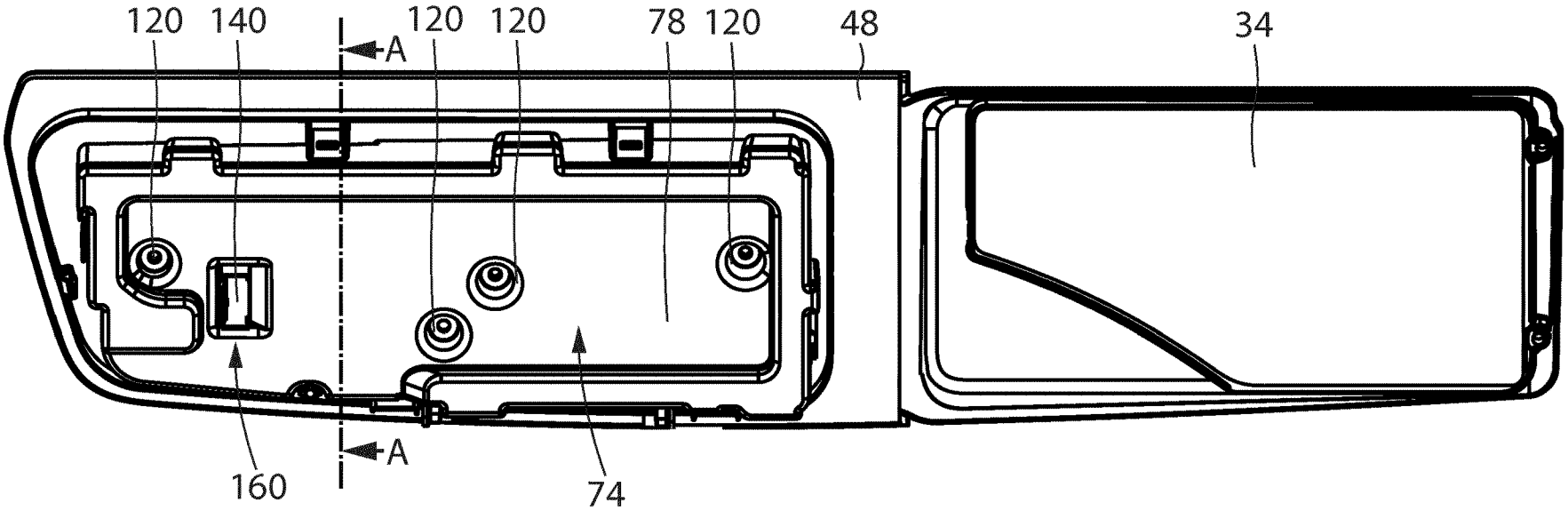
FIG. 3 shows a rear view of front panel, box, electronic board and cover in an assembled state.

In FIG. 3, in a rear view, front panel 48, box 68, board 72 and cover 78 are shown in an assembled state in a rear view. Cover 78 of which a rear side 74 is shown comprises openings 120 which respectively receive screws. Cover 78 preferably comprises an opening 160 through which the contacts which are arranged within connector cage 140 are accessible.

Figure 5:
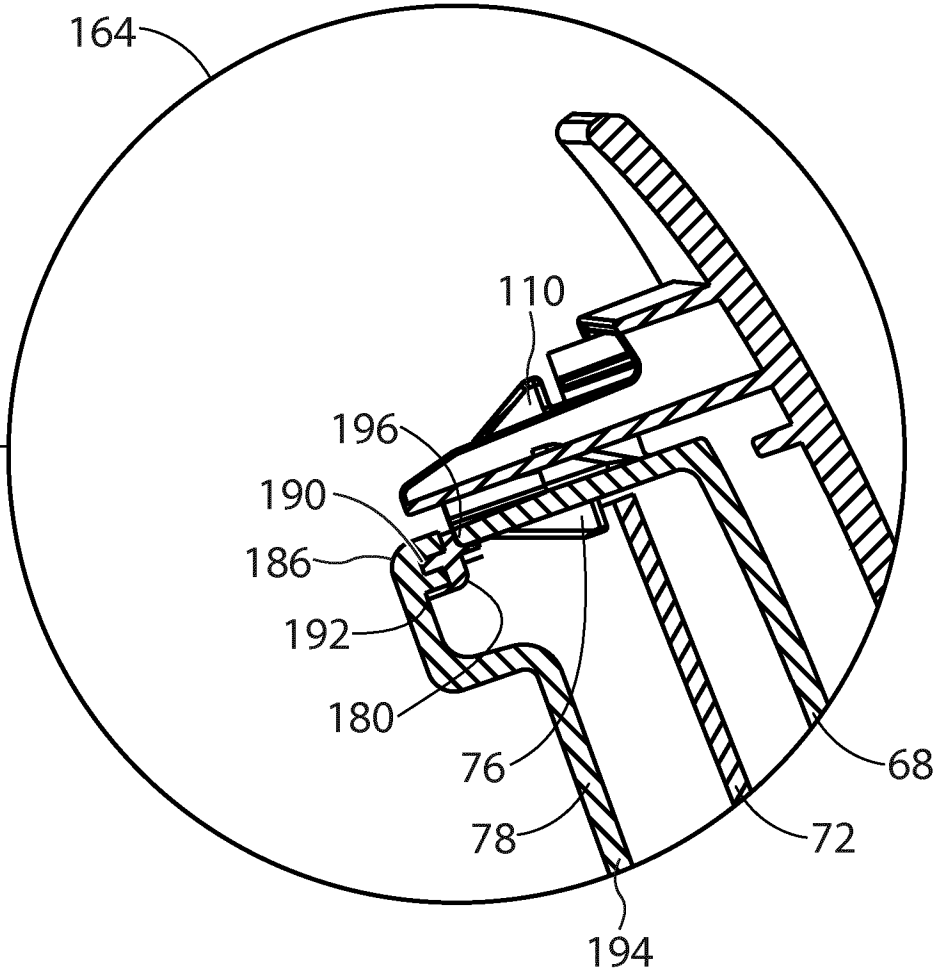
FIG. 5 shows an enlarged partial view of FIG. 4.
Figure 4:
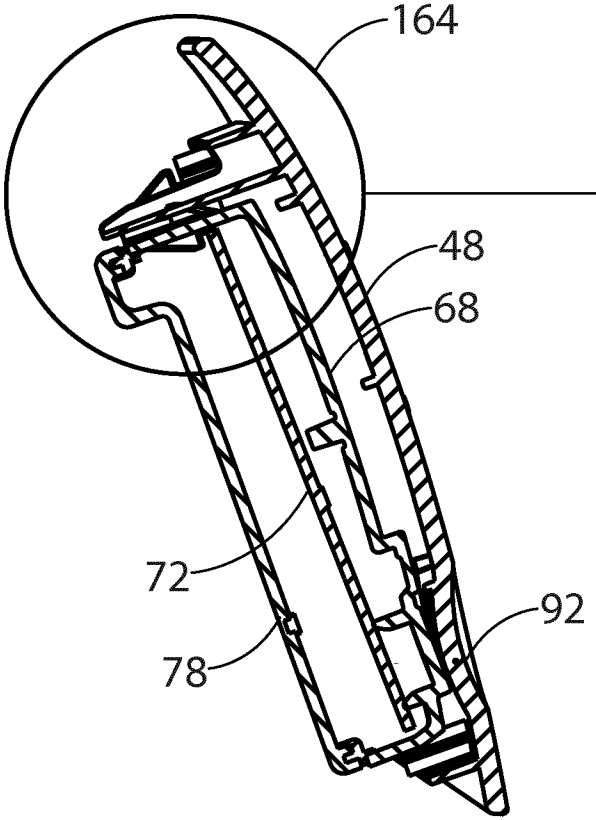
FIG. 4 shows the assembly according to FIG. 3 in cross-sectional view along line A-A.
Figure 6:
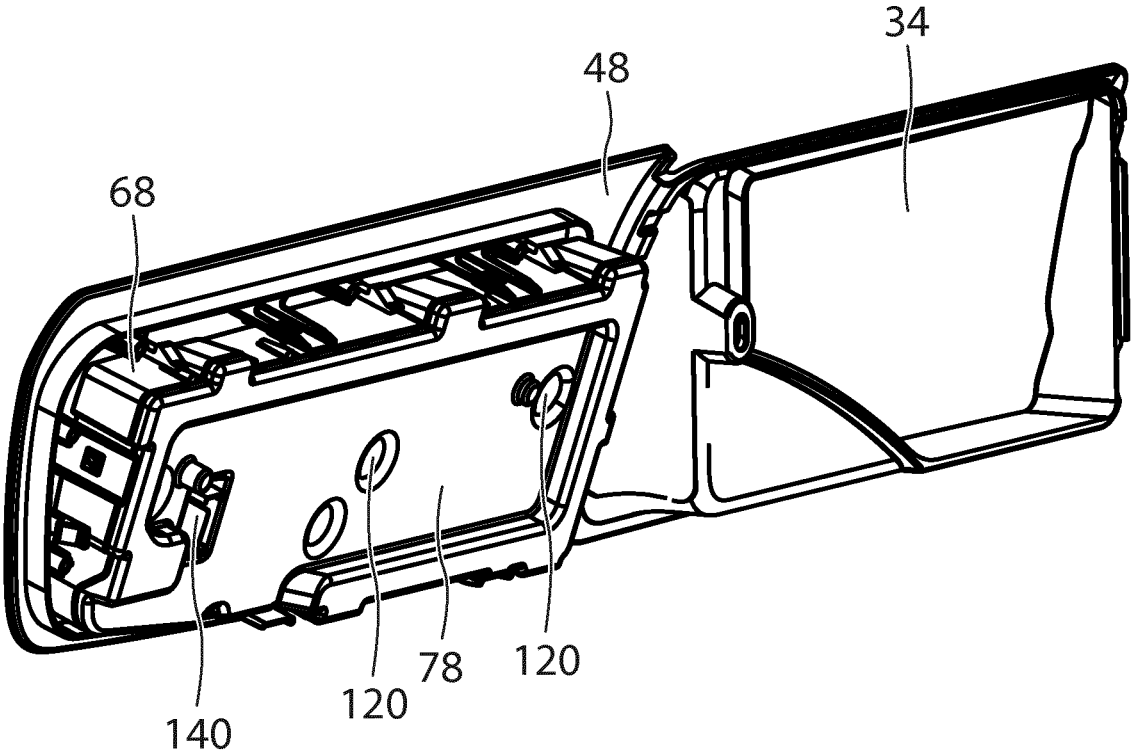
FIG. 6 shows an isometric rear view of the assembly of front panel, box, electronic board and cover with the cover attached.
Figure 7:
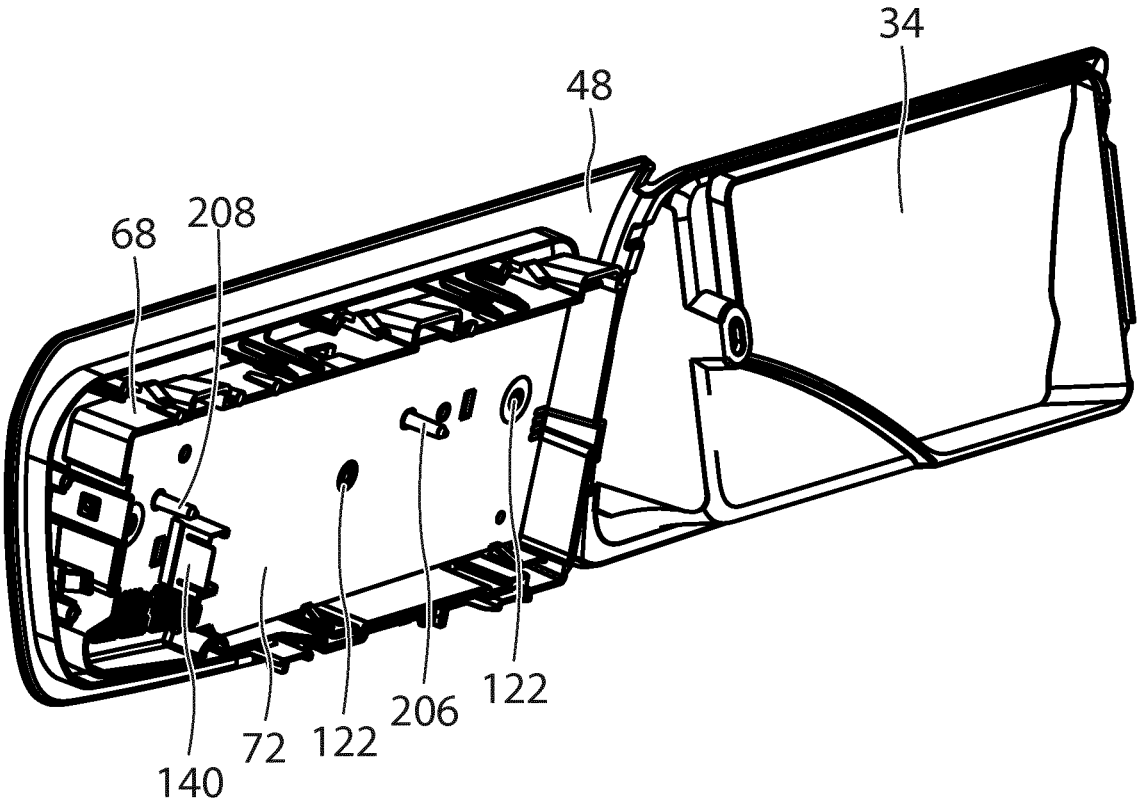
FIG. 7 shows an isometric rear view of the assembly with the cover removed.

In FIG. 4, a section along line A-A of FIG. 3 is shown, and in FIG. 5, an enlarged view of components drawn in a circle 164 in FIG. 4 is shown. Snap means 76 are provided on cover 78 for the electronic board engagement and snap means 110 on frontal plate 48 are visible The connection between cover 78 and box 68 is made in such a way that the electronic board 72 is at least partially protected from water, steam or contaminating particles which can be present in laundry treatment appliance 2. This is achieved by a sealing element which is preferably provided on cover 78 and which in the present preferred embodiment is a gasket 180 made preferably of rubber. Cover 78 preferably comprises at its periphery a frame 186 with two parallel shoulders 190, 192 which are perpendicular to a center plate 194 of cover 78 and between which a groove 196 is formed. In particular, shoulder 190 is an outer shoulder and shoulder 192 is an inner shoulder and is located closer to a center of cover 78.

Shoulder 192 has a smaller extension in a direction towards front panel 48. Gasket 180 is preferably co-molded to cover 78 and is located within groove 196. Gasket 180 also covers shoulder 190. In the assembled state, the gasket 180 is in contact with box 68 and in this way acts as a sealing element. Groove 196 and gasket 180 are preferably arranged along the whole periphery of cover 78, thereby provided a fully sealed connection between box 68 and cover 78 and reliably preventing steam, water or particles to enter box 68 and to lead to malfunctions or defects of electronic board 72. In an alternative preferred embodiment, gasket 180 is provided only partially along the periphery of cover 78, which means that not necessarily all sides of the periphery are provided with a gasket 180 and/or on one or more sides the gasket 180 is not provided over the whole length of the side. This variant is advantageous if cover 78 and box 68 are built or designed in such a way that connecting parts without gasket 180 already provide reliable protection against steam, water or particles. On box 68, pins 206, 208 are provided which in the assembled state reach through corresponding holes in board 72 and lead to further stabilization of the assembly.

Figure 8:
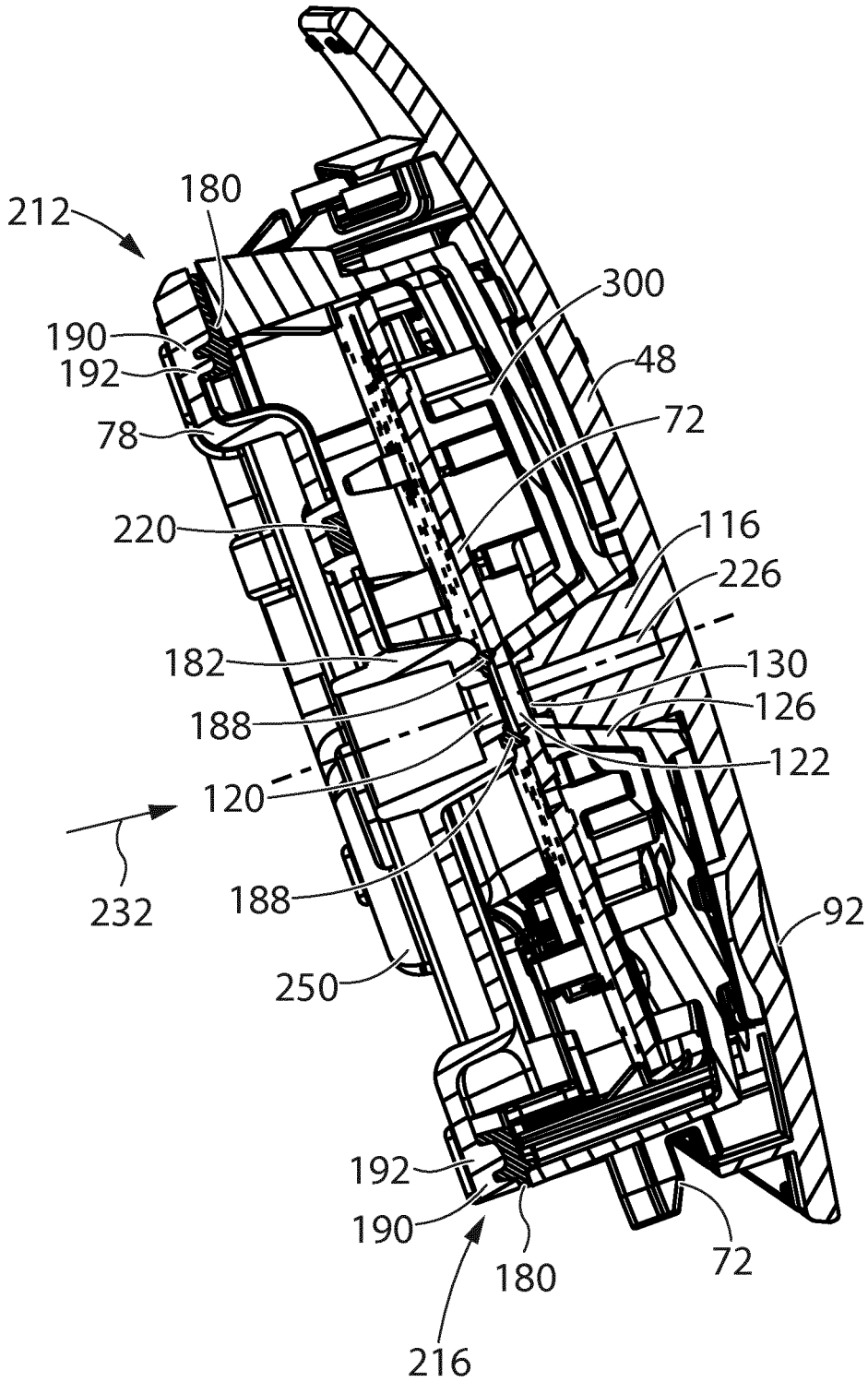
FIG. 8 shows a cross-sectional view of the assembly.

In FIG. 8, a cross section of front panel 48, box 68 and cover 78 is shown. On a first side 212, outer shoulder 190 is preferably wider or broader than an opposing side 216. On cover 78, gasket tracks 220 are provided which are discussed below. A bore 226 or hole is provided on front panel 48 for inserting a screw. Bore 226 comprises an inner thread which engages with an outer thread of the screw.

The screw is lead inserted in an insertion direction 232 through an opening in a dome 182 provided on cover 78 and subsequently through an opening in a dome 126 provided on box 68. A corresponding hole or opening 122 is provided on electronic board 72 through which the screw is lead.

A light guide 300 is provided between electronic board 72 and box 68 for guiding light emitted from light elements provided on electronic board 72 to the front panel 48. These light elements on board 72 are preferably LEDS.

Figure 9:
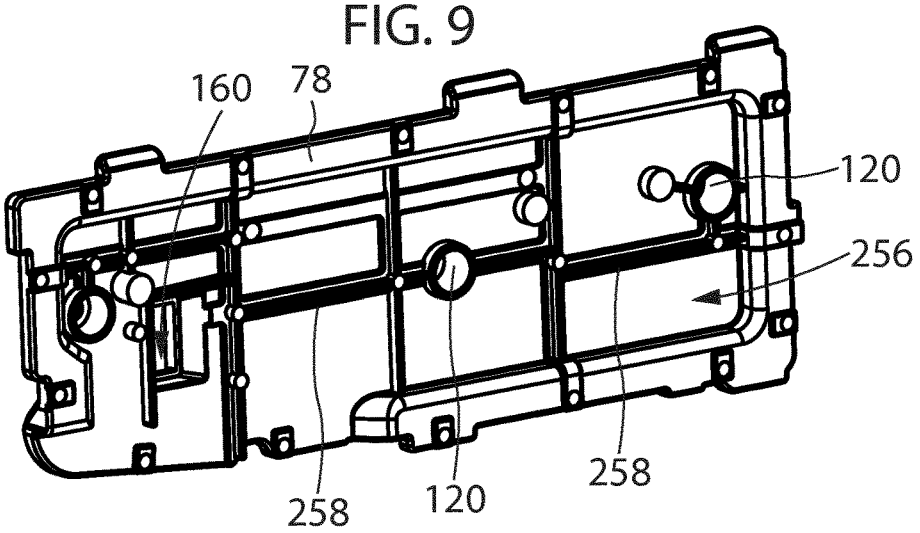
FIG. 9 shows a perspective rear view of the cover.
Figure 10:
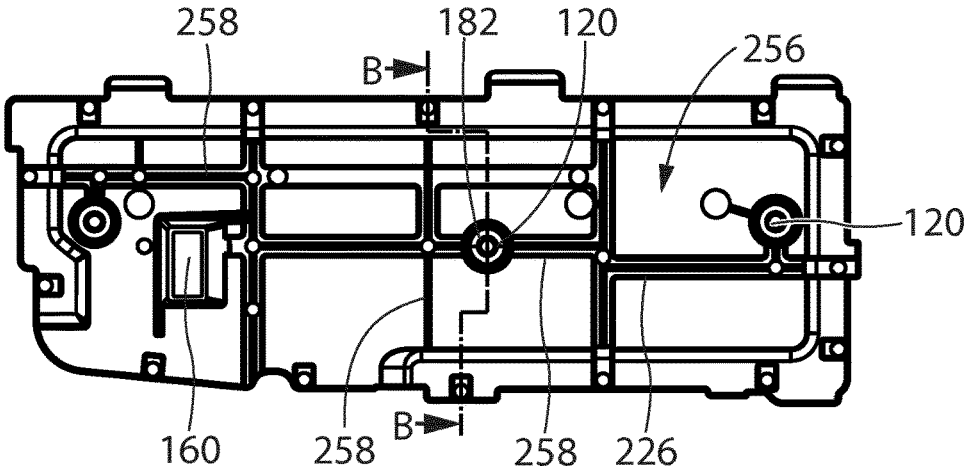
FIG. 10 shows a rear view of the cover.

In FIG. 9, a rear side 256 of cover 78 is shown in an isomeric view and in FIG. 10 in a frontal view. In an assembled state, rear side 256 is opposite to a front side of cover 78 which faces electronic board 72. On rear side 256, ribs 258 are seen which are preferably behind the gasket tracks 220 on the front side of cover 78. Cover 78 comprises an opening 160 for a connector cage.

Figure 11:
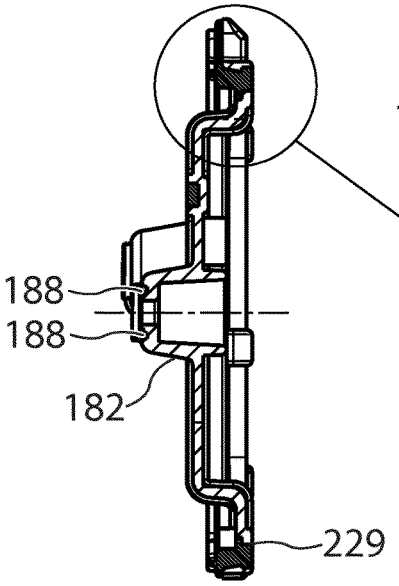
FIG. 11 shows a cross-sectional view of the cover according to FIG. 10 along line B-B.
Figure 12:
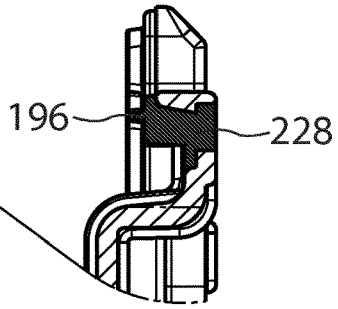
FIG. 12 shows an enlarged view of FIG. 11.
Figure 13:
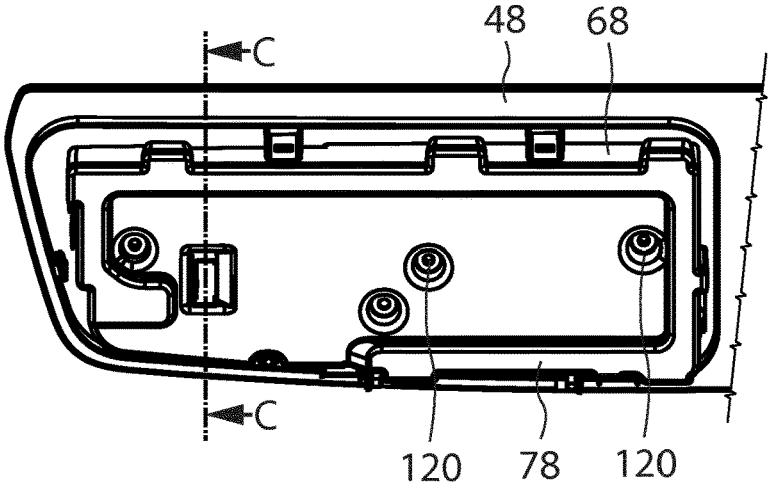
FIG. 13 shows a rear view of the cover assembled to the box.
Figure 14:
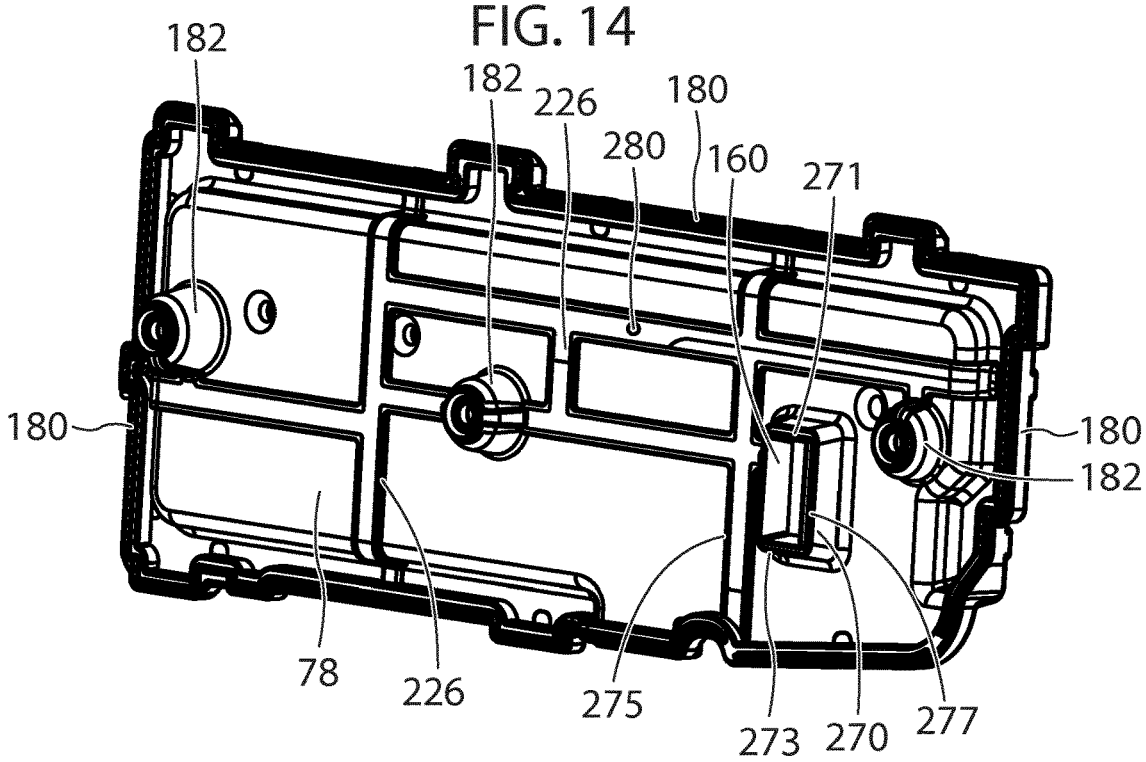
FIG. 14 shows a front view of the cover.
Figure 15:
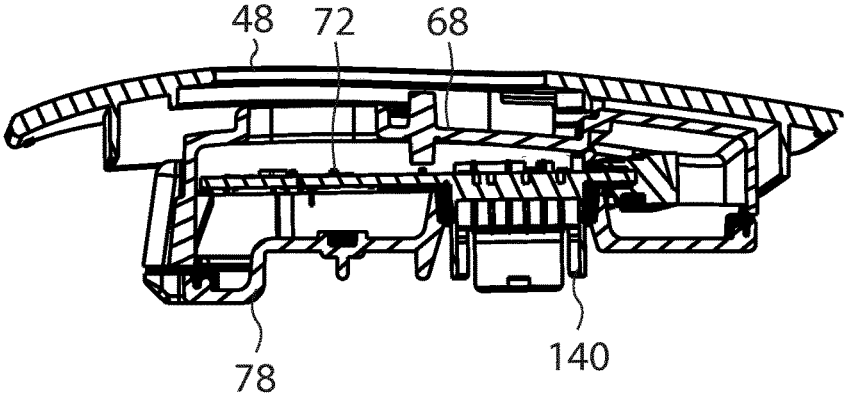
FIG. 15 shows a cross sectional view of the assembly according to FIG. 13 along line C-C.

In FIG. 11, a cut through cover 78 along the line B-B shown in FIG. 10 is shown, of which a part encircled by a circle is shown in FIG. 12. A through hole 228 reaching through to the groove 196 serves to improve the fixation of the gasket on the cover 78 by sticking to both components. As can be seen in FIG. 14, the respective opening 120 is surrounded by a dome 182. On dome 182, on its side which in the assembled state faces electronic board 72, a gasket 188 is provided. This gasket 188 provides a frontal sealing effect, preventing water, moisture or particles to pass between electronic board 72 and gasket 188.

In FIG. 14, the front side of cover 78 which in the assembled state faces electronic board 72 is shown in a perspective view. Gasket tracks 226 are shown which lead liquid material which is injected in an injection point 280.

Opening 160 which in an assembled state allows access to the connector cage 140 is surrounded by a gasket 270 which seals the connection or interface region between gasket connector cage and cover 78. The opening 160 has preferably a rectangular shape. Gasket 270 is preferably formed with a frontal lip 271, a back lip 273 and two side lips 275, 277. The length or extension of all lips 271, 273, 275, 277 are dimensioned to provide a sealed connection to connector cage 140, preventing in the assembled state for moisture or particles to enter through gaps between gasket 270 and connector cage 140.

In this way, simultaneously the connectors located inside connector cage 140 are accessible and this connection region is sealed against steam, water and other particles, avoiding them to enter the box 68 and possibly leading to malfunctions or defects of electronic board 72. The invention also concerns a cover 78 which comprises gasket 270 but without the peripheral gasket 180.

The gasket 180 and preferably also the gasket 270 are produced in the same co-molding process in which liquid material is injected in at least one injection point 280 and is by running through gasket tracks 226 and is distributed in grooves to form the gaskets 180, 270.

Figure 16:
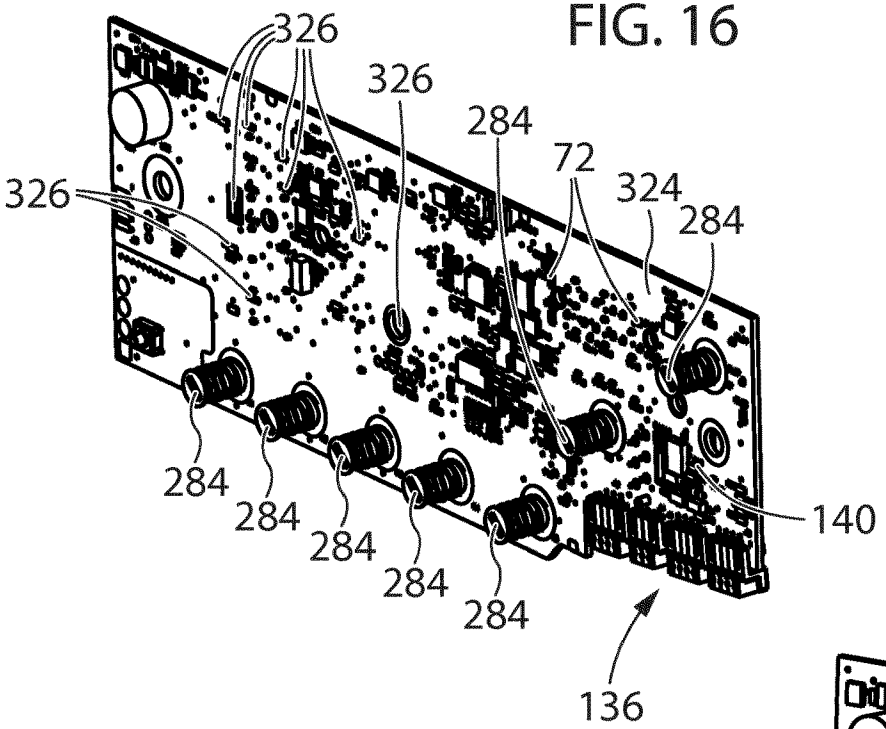
FIG. 16 shows an electronic board according to the invention.

In FIG. 16 electronic board 72 in a first preferred embodiment is shown. On board 72, several spring contacts 284 are provided which can be activated on the user interface provided on front panel 48. On board 72, several light elements 324, 326 are provided which are preferably built as LEDs.

Figure 17:
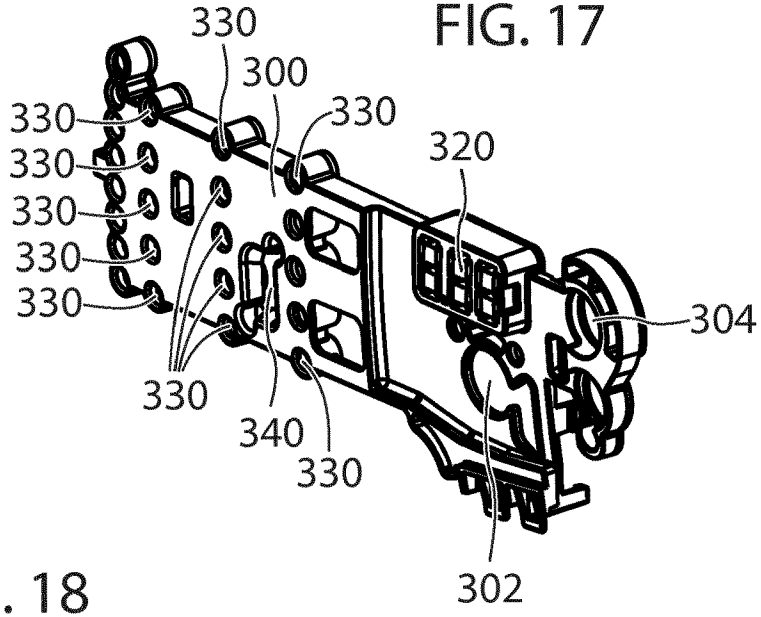
FIG. 17 shows a top frame for housing light guides.
Figure 18:
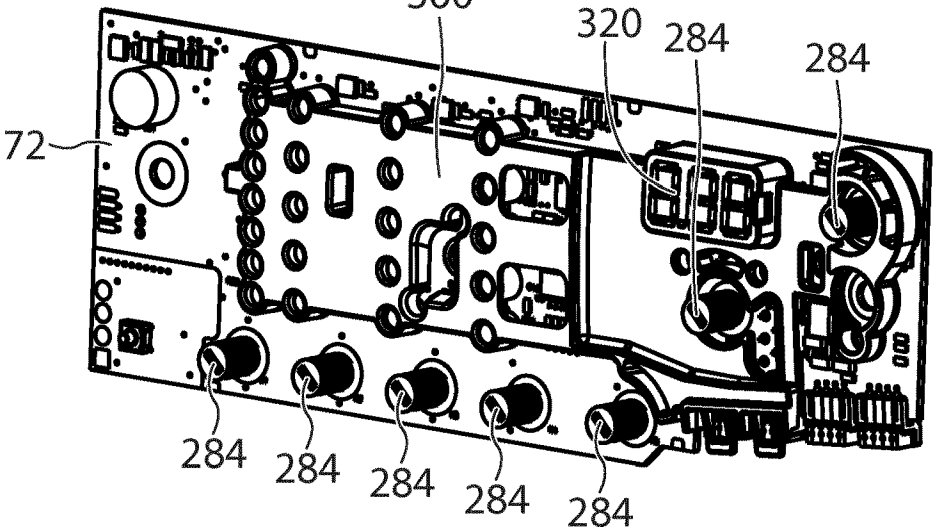
FIG. 18 shows the electronic board according to FIG. 16 with the frame according to FIG. 17 attached.

In FIG. 17, a top frame 300 is shown which is mounted on board 72. Frame 300 is an additional component which preferably serves especially to house light guided in channels 330 which transmit light emitted from corresponding light elements on board 72 to the user interface. Frame 300 preferably comprises a display unit 320. Frame 300 and a board 72 in an assembled state are shown in FIG. 18. The display unit 320 is illuminated by light elements 324 on electronic board 72. The display unit 320 is preferably used to indicate status information to the user, for instance the selected treatment program and/or parameters thereof and/or a corresponding status. An opening 340 allows the passage of dome 126 on box 68 during assembly.

The household appliance 2 is according the invention manufactured as follows. The electronic board 72 is placed inside the box 68. Before this step or afterwards or simultaneously, the cover 78 is placed in a mold, and a gasket 180 is co-molded to cover 78 in such a way that a sealing connection between box 69 and cover 78 is achieved in the assembled state. The gasket 180 is preferably over-injected in cover 78. Finally, the box is closed by the cover 78.

In order to facilitate the over-injection process, preferably the at least one at least at least partially circumferential groove 196 is provided. The material to be co-molded in the liquid state then can flow from the injection point 280 into the groove 196, preferably by gasket tracks 220 or connecting tracks.

The invention thus conceived can be subjected to numerous modifications and variants all falling within the scope of the inventive concept. In addition, all details can be replaced by other technically equivalent elements. In practice, all the materials used, as well as the shapes and contingent dimensions, may vary depending on the requirements without departing from the scope of protection of the following claims.

The invention claimed is:

1. A household appliance comprising:

an electronic board;

a receptacle configured to receive the electronic board;

a cover configured to close the receptacle, whereby the cover, in an assembled state is connected to the receptacle such that the electronic board is sandwiched between the receptacle and the cover, the cover including at least one opening;

a gasket co-molded on the cover, the gasket including an outer portion co-molded around a perimeter of the cover and an inner portion co-molded around the at least one opening of the cover; and a fixing means for providing a connection between the receptacle and the cover in the assembled state, whereby in the assembled state, the outer portion of the gasket provides an outer sealed connection between the receptacle and the cover, and the inner portion of the gasket provides an inner sealed connection between the at least one opening of the cover and the electronic board, wherein the outer portion and the inner portion of the gasket are co-molded together via tracks in the cover such that gasket is a singular gasket.

2. The household appliance according to claim 1, wherein the fixing means provide a removable connection between the receptacle and the cover.

3. The household appliance according to claim 1, wherein the cover at its periphery comprises a groove, and wherein the gasket is positioned at least partially inside the groove.

4. The household appliance according to claim 1, wherein the cover comprises a frontal side which in an assembled state faces the electronic board and a back side opposed to the frontal side, and wherein on the frontal side of the cover, gasket tracks are provided which in an assembled state face the electronic board.

5. The household appliance according to claim 4, wherein the cover at its periphery comprises a frame from which two parallel shoulders protrude to form the groove between them, and wherein the gasket is positioned at least partially inside the groove and covers at least one of the shoulders, wherein in the assembled state the gasket is arranged between at least one shoulder and a side surface of the receptacle, thereby sealing the connection between the receptacle and the cover.

6. The household appliance according to claim 1, wherein the receptacle comprises at least one dome for insertion of a screw, and wherein the electronic board comprises at least one hole, and wherein the cover comprises at least one opening, wherein the dome, the hole and the opening are axially aligned in an assembled state so that a fixing element is lead through the opening and the hole and through the dome.

7. The household appliance according to claim 1, comprising a faceplate, and a removable connection between the receptacle and the faceplate.

8. The household appliance according to claim 7, wherein the faceplate comprises a user interface.

9. The household appliance according to claim 1, wherein the electronic board comprises a connector cage encompassing at least one contact, and wherein a connector sealing element is provided on the cover which at least partially in a sealing manner encompasses the connector cage.

10. The household appliance according to claim 9, wherein the connector sealing element is a gasket co-molded to the cover.

11. The household appliance according to claim 1, wherein the fixing means extends through the receptacle, the electronic board and the cover, and fixes the receptacle, the electronic board and the cover together.

12. The household appliance according to claim 1, wherein the fixing means extends through a middle portion of the electronic board.

13. The household appliance according to claim 1, wherein the cover and receptacle include domed protrusions that contact opposite sides of the electronic board and accept the fixing means.

14. The household appliance according to claim 1, wherein the outer portion of the co-molded gasket is located in a track of the cover, and the outer portion of the co-molded gasket includes a protrusion that extends into a groove within the track of the cover.

* * * * *